US010792678B2

(12) United States Patent
Lu et al.

(10) Patent No.: US 10,792,678 B2
(45) Date of Patent: Oct. 6, 2020

(54) ENERGY-SAVING AND HIGH-EFFICIENCY SHOWER HEAD CAPABLE OF PRODUCING PULSATING STREAM

(71) Applicant: XIAMEN EASO CO., LTD., Xiamen, Fujian (CN)

(72) Inventors: Haitao Lu, Xiamen (CN); Zhen Li, Xiamen (CN); Yuebin Yang, Xiamen (CN); Ximin Chen, Xiamen (CN)

(73) Assignee: XIAMEN EASO CO., LTD., Xiamen, Fujian (CN)

( * ) Notice: Subject to any disclaimer, the term of this patent is extended or adjusted under 35 U.S.C. 154(b) by 47 days.

(21) Appl. No.: 16/260,105

(22) Filed: Jan. 29, 2019

(65) Prior Publication Data

US 2020/0070181 A1 Mar. 5, 2020

(30) Foreign Application Priority Data

Sep. 3, 2018 (CN) ..... 2018 2 1433151 U

(51) Int. Cl.
*B05B 1/08* (2006.01)
*B05B 1/18* (2006.01)

(52) U.S. Cl.
CPC ..... *B05B 1/083* (2013.01); *B05B 1/18* (2013.01)

(58) Field of Classification Search
CPC ..... B05B 1/083; B05B 1/18
USPC ..... 239/381–383, 562
See application file for complete search history.

(56) References Cited

U.S. PATENT DOCUMENTS 8,905,332 B2 * 12/2014 Luettgen ..... B05B 1/1654 239/463

* cited by examiner

*Primary Examiner* — Christopher S Kim
(74) *Attorney, Agent, or Firm* — Chun-Ming Shih

(57) ABSTRACT

An energy-saving and high-efficiency shower head capable of producing a pulsating stream includes a main body having an inlet opening, an upper cover and a cover plate connected to the underside of the main body, a water-stop mechanism, and a face plate. The cover plate is formed with a water-passing chamber and a pulsating chamber having an oblique hole. The pulsating chamber is provided with at least two diversion holes to form two outlet passages. The water-stop mechanism is composed of an impeller and a water-stop piece disposed on the impeller. The water-stop piece alternately blocks one of diversion holes when the impeller rotates to intermittently open and close the outlet passages corresponding to the diversion holes, providing a pulsating stream effect.

6 Claims, 5 Drawing Sheets

ENERGY-SAVING AND HIGH-EFFICIENCY SHOWER HEAD CAPABLE OF PRODUCING PULSATING STREAM

BACKGROUND OF THE INVENTION

1. Field of the Invention

The present invention relates to a shower apparatus, and more particularly to an energy-saving and high-efficiency shower head capable of producing a pulsating stream.

2. Description of the Prior Art

The requirements for the function of a shower head (handheld shower or shower nozzle) are increasing, and the spray effect of the shower head is constantly improving. Therefore, most of the shower heads on the market have various spray modes, such as shower water, massage water, waterfall water or spray water, etc. Each spray mode has a different bathing effect. For this reason, the present invention develops an energy-saving and high-efficiency shower head capable of producing a pulsating stream to enrich the spray mode of the shower head.

SUMMARY OF THE INVENTION

The primary object of the present invention is to provide an energy-saving and high-efficiency shower head capable of producing a pulsating stream to provide a soft and good bathing effect.

In order to achieve the above object, the present invention adopts the following technical solutions. An energy-saving and high-efficiency shower head capable of producing a pulsating stream comprises a main body, an upper cover, a cover plate, a water-stop mechanism, and a face plate. The main body has an inlet opening. The upper cover is connected to the main body and located under the main body. The upper cover has a through hole communicating with the inlet opening. The cover plate is connected to the man body and located under the upper cover. The cover plate is formed with a water-passing chamber and a pulsating chamber. The water-passing chamber communicates with the through hole of the upper cover. The pulsating chamber communicates with a water passage of the water-passing chamber. A wall of the pulsating chamber is provided with an oblique hole. The pulsating chamber is provided with at least two diversion holes to form corresponding outlet passages. The water-stop mechanism is composed of an impeller and a water-stop piece. The impeller is rotatably disposed in the pulsating chamber and located above the diversion holes. The water-stop piece is disposed on the impeller. The water-stop piece alternately blocks one of the diversion holes when the impeller rotates to intermittently open and close the outlet passages corresponding to the diversion holes. The face plate is sealedly connected to the cover plate. An inner surface of the face plate is formed with an outlet chamber corresponding to and communicating with the distribution holes of the cover plate. A bottom surface of the face plate is provided with outlet holes corresponding to the outlet chamber.

Preferably, the outlet chamber of the face plate is partitioned into a middle outlet chamber and an outer annular outlet chamber.

Preferably, the water-stop piece is fixedly connected to the impeller.

Preferably, the water-stop piece is integrally formed with the impeller.

Preferably, the water-stop piece has a semicircular or fan shape.

Preferably, the diversion holes of the cover plate are provided with check valves.

Preferably, the impeller is mounted in the pulsating chamber through a connecting shaft.

In use, water enters from the inlet opening of the main body and enters the water-passing chamber of the cover plate through the through hole of the upper cover. The water in the water-passing chamber is injected into the impeller from the oblique hole of the pulsating chamber, so that the impeller is rotated at a high speed. The water-stop piece at the underside of the impeller alternately blocks one of the diversion holes of the cover plate along with the rotation of the impeller. That is, the water passages between the diversion holes and the outlet chambers of the face plate are alternately opened and closed, so that the outlet holes corresponding to the respective outlet chambers of the face plate alternately spray water, thereby forming a pulsating stream effect. The present invention saves water and energy, and the shower water is soft and more comfortable.

DETAILED DESCRIPTION OF THE PREFERRED EMBODIMENTS

Embodiments of the present invention will now be described, by way of example only, with reference to the accompanying drawings.

Figure 1:
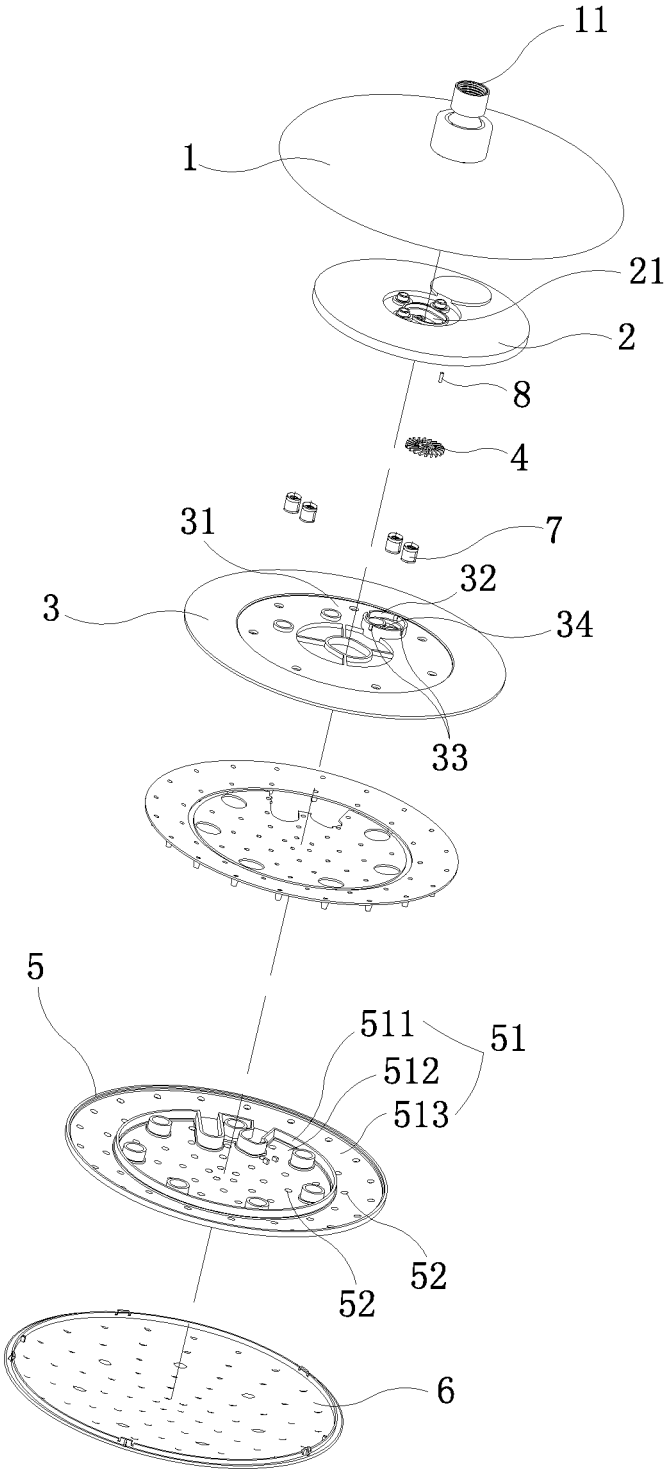
FIG. 1 is an exploded view of the present invention.
Figure 2:
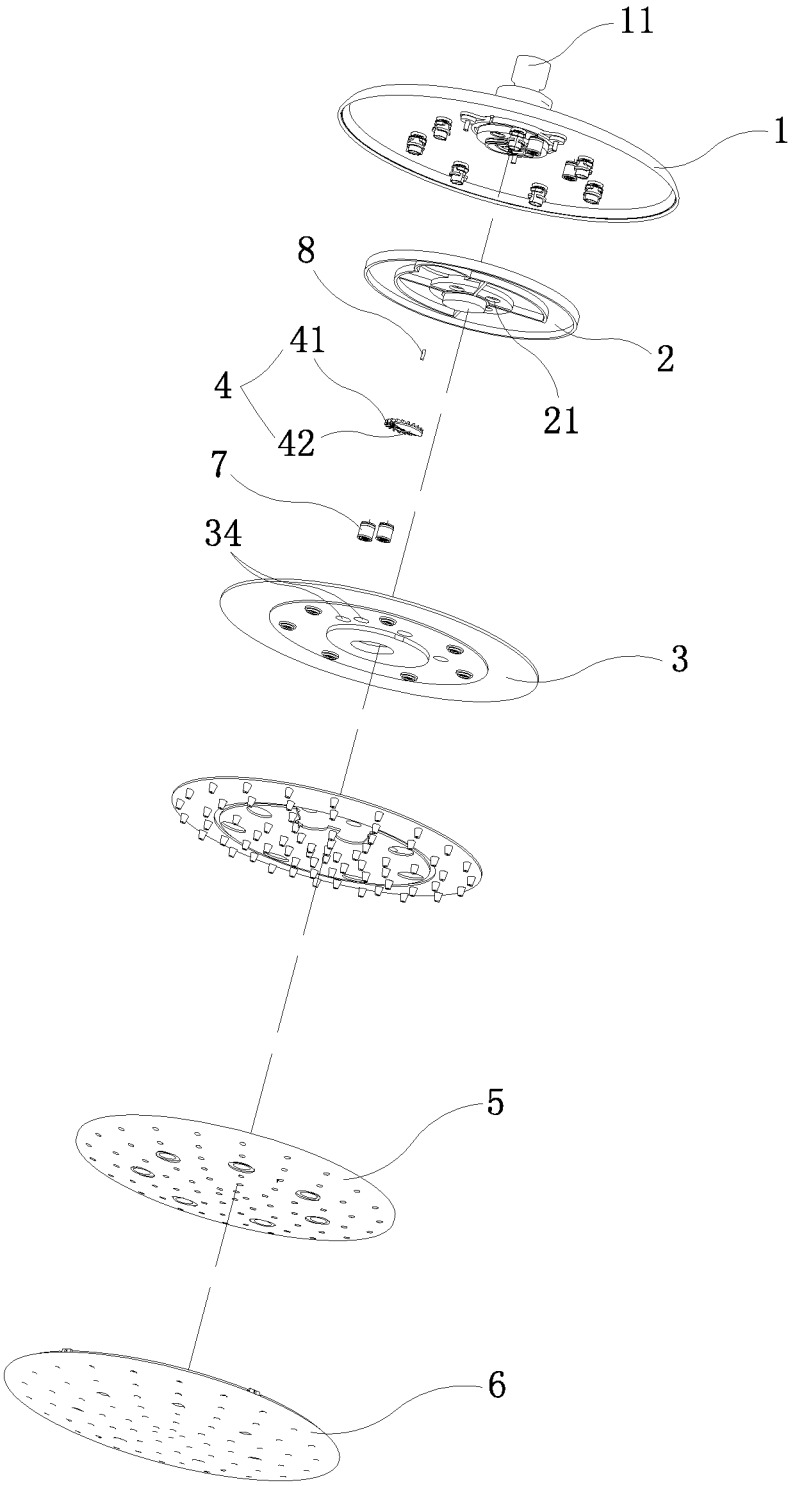
FIG. 2 is another exploded view of the present invention.
Figure 3:
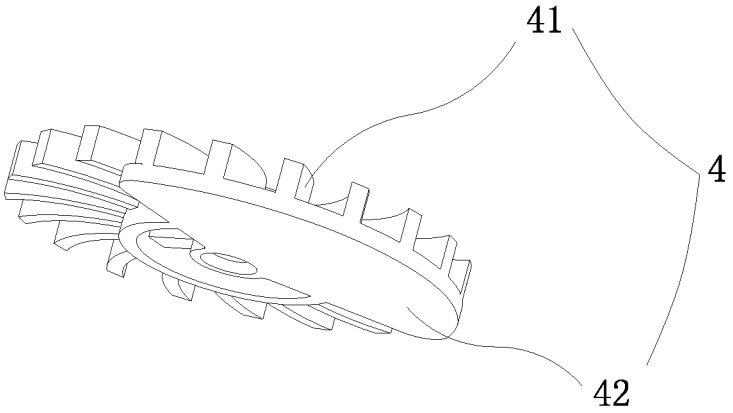
FIG. 3 is a perspective view of the water-stop mechanism of the present invention.
Figure 4:
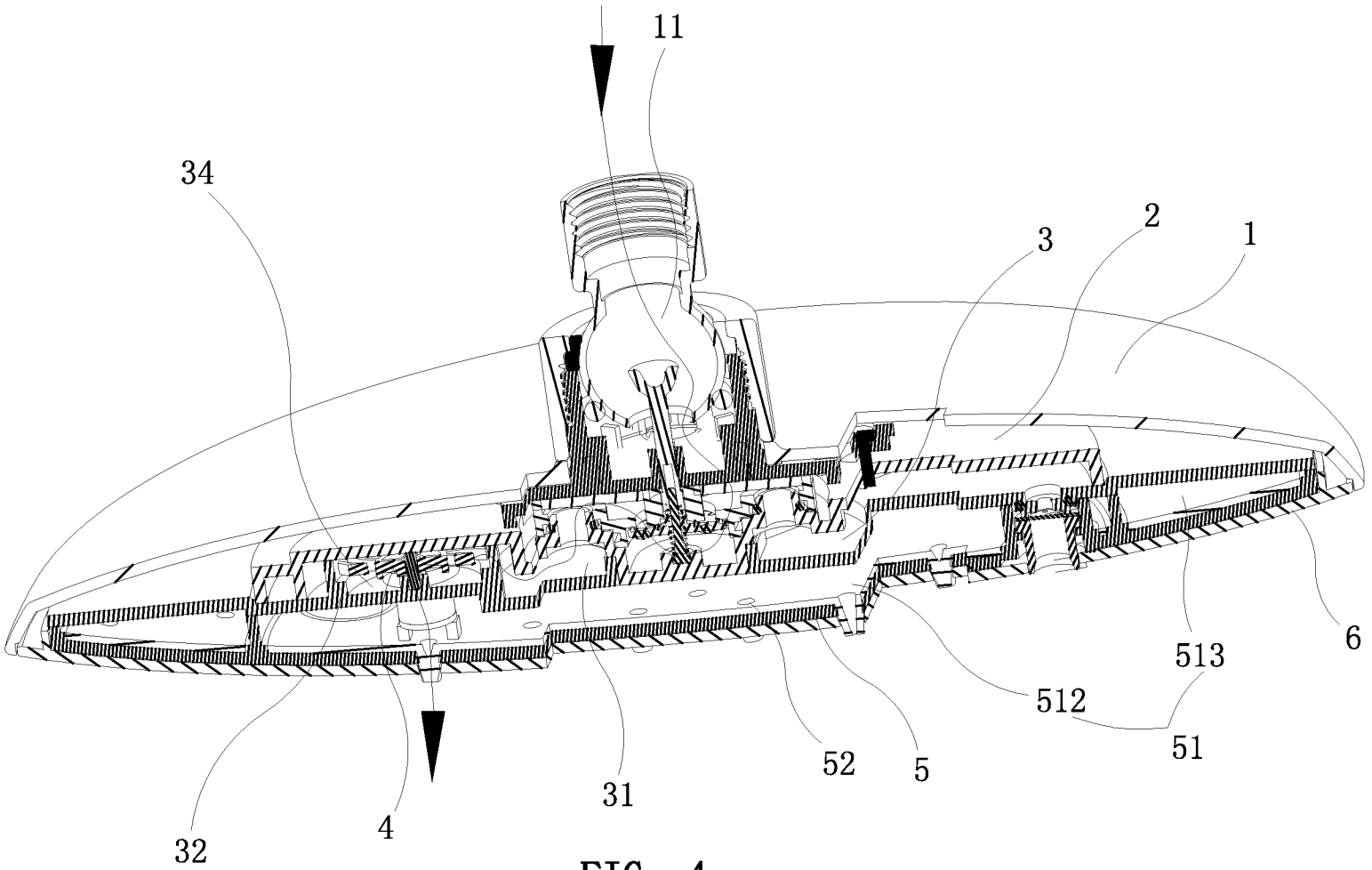
FIG. 4 is a cross-sectional view of the present invention.
Figure 5:
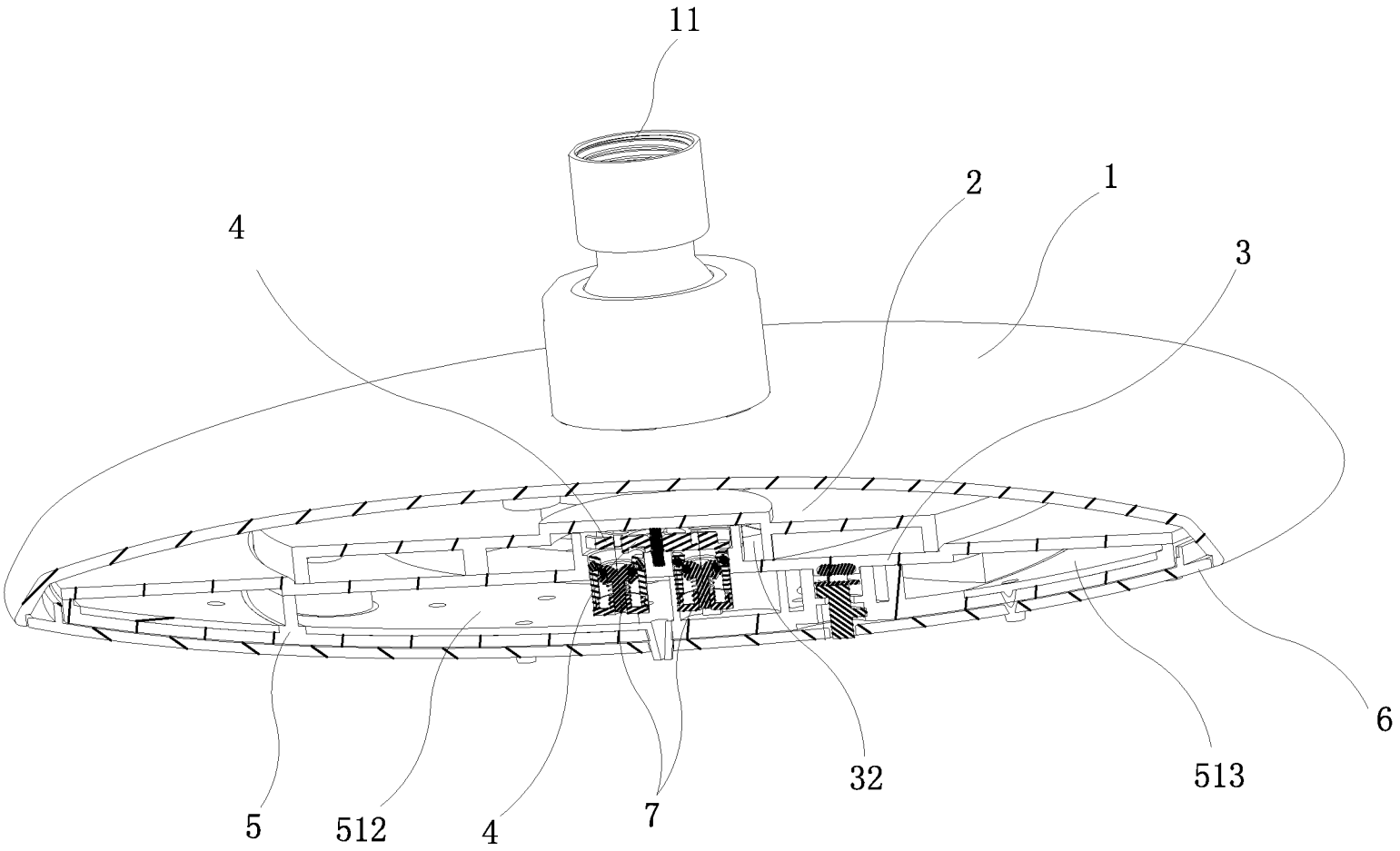
FIG. 5 is a partially cross-sectional view of the present invention.

As shown in FIG. 1 to FIG. 5, the energy-saving and high-efficiency shower head capable of producing a pulsating stream of the present invention comprises a main body 1, an upper cover 2, a cover plate 3, a water-stop mechanism 4, and a face plate 5. The main body 1 has an inlet opening 11 connected to an external water source. The upper cover 2 is connected to the main body 1 and located under the main body 1. The upper cover 2 has a through hole 21 communicating with the inlet opening 11. The cover plate 3 is connected to the man body 1 and located under the upper cover 2. The cover plate 3 is formed with a water-passing chamber 31 and a pulsating chamber 32. The water-passing chamber 31 communicates with the through hole 21 of the upper cover 2. The pulsating chamber 32 communicates with the water passage of the water-passing chamber 31. The wall of the pulsating chamber 32 is provided with an oblique hole 33. The bottom of the pulsating chamber 32 is provided with at least two diversion holes 34 to form corresponding outlet passages. In this embodiment, two diversion holes 34 are taken as an example. The water-stop mechanism 4 is composed of an impeller 41 and a water-stop piece 42. The impeller 41 is rotatably disposed in the pulsating chamber 32 and located above the diversion holes 34. The impeller 41 can be rotated at a high speed under the impact of the water flow. The water-stop piece 42 is disposed on the impeller 41. In this embodiment, the water-stop piece 42 is disposed on the underside of the impeller 41. The water-stop piece 42 alternately blocks one of the diversion holes 34 of the pulsating chamber 32 when the impeller 41 rotates to intermittently open and close the outlet passages corresponding to the diversion holes 34. The water-stop piece 42 is fixedly connected to the impeller 41 to form a linkage or is integrally formed with the impeller 41. The water-stop piece 42 may have a semicircular or fan shape. The face plate 5 is sealedly connected to the cover plate 3. The inner surface of the face plate 5 is formed with an outlet chamber 51 corresponding to and communicating with the distribution holes 34 of the cover plate 3. The bottom surface of the face plate 5 is provided with outlet holes 52 corresponding to the outlet chamber 51. In this embodiment, the outlet chamber 51 of the face plate 5 is partitioned into a middle outlet chamber 512 and an outer annular outlet chamber 513 by a partition 511. The middle outlet chamber 512 and the outer annular outlet chamber 513 respectively communicate with the two diversion holes 34 of the cover plate 3 to form two outlet passages.

The face plate 5 is provided with a decorative cover 6.

The two diversion holes 34 are provided with check valves 7 for preventing backflow of water.

The impeller 4 is mounted in the pulsating chamber 32 through a connecting shaft 8.

In use, water enters from the inlet opening 11 of the main body 1 and enters the water-passing chamber 31 of the cover plate 3 through the through hole 21 of the upper cover 2. The water in the water-passing chamber 31 is injected into the impeller 41 from the oblique hole 33 of the pulsating chamber 32, so that the impeller 41 is rotated at a high speed. The water-stop piece 42 at the underside of the impeller 41 alternately blocks one of the diversion holes 34 of the cover plate 3 along with the rotation of the impeller 41. That is, the water passages between the diversion holes 34 and the outlet chambers 51 of the face plate 5 are alternately opened and closed, so that the outlet holes 52 corresponding to the respective outlet chambers 51 of the face plate 5 alternately spray water, thereby a forming pulsating stream. The present invention saves water and energy, and the shower water is soft and more comfortable.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. An energy-saving and high-efficiency shower head capable of producing a pulsating stream, comprising a main body, an upper cover, a cover plate, a water-stop mechanism, and a face plate; the main body having an inlet opening, the upper cover being connected to the main body and located under the main body, the upper cover having a through hole communicating with the inlet opening;

the cover plate being connected to the main body and located under the upper cover, the cover plate being formed with a water-passing chamber and a pulsating chamber, the water-passing chamber communicating with the through hole of the upper cover, the pulsating chamber communicating with a water passage of the water-passing chamber, a wall of the pulsating chamber being provided with an oblique hole, the pulsating chamber being provided with at least two diversion holes to form corresponding outlet passages;

the water-stop mechanism being composed of an impeller and a water-stop piece, the impeller being rotatably disposed in the pulsating chamber and located above the diversion holes, the water-stop piece being disposed on the impeller, the water-stop piece alternately blocking one of the diversion holes when the impeller rotates to intermittently open and close the outlet passages corresponding to the diversion holes;

the face plate being sealedly connected to the cover plate, an inner surface of the face plate being formed with an outlet chamber corresponding to and communicating with distribution holes of the cover plate, a bottom surface of the face plate being provided with outlet holes corresponding to the outlet chamber, wherein the diversion holes of the cover plate are provided with check valves.

2. The energy-saving and high-efficiency shower head as claimed in claim 1, wherein the outlet chamber of the face plate is partitioned into a middle outlet chamber and an outer annular outlet chamber.

3. The energy-saving and high-efficiency shower head as claimed in claim 1, wherein the water-stop piece is fixedly connected to the impeller.

4. The energy-saving and high-efficiency shower head as claimed in claim 1, wherein the water-stop piece is integrally formed with the impeller.

5. The energy-saving and high-efficiency shower head as claimed in claim 1, wherein the water-stop piece has a semicircular or fan shape.

6. The energy-saving and high-efficiency shower head as claimed in claim 1, wherein the impeller is mounted in the pulsating chamber through a connecting shaft.

* * * * *